US005540293A

United States Patent [19]

Mohaupt

[11] Patent Number: 5,540,293

[45] Date of Patent: Jul. 30, 1996

[54] FIRING HEAD

[75] Inventor: Henry H. Mohaupt, Santa Barbara, Calif.

[73] Assignee: The Mohaupt Family Trust, Santa Barbara, Calif.

[21] Appl. No.: 392,472

[22] Filed: Feb. 21, 1995

[51] Int. Cl.[6] ..... E21B 43/116

[52] U.S. Cl. ..... 175/3.5; 175/4.56; 166/297

[58] Field of Search ..... 175/3.5, 4.56; 166/297, 298, 55, 55.1

[56] References Cited

U.S. PATENT DOCUMENTS

| | | | |
|---|---|---|---|
| 2,067,408 | 1/1937 | Morris . | |
| 2,254,979 | 9/1941 | Ricou . | |
| 2,760,408 | 8/1956 | Taylor . | |
| 4,260,017 | 4/1981 | Nelson et al. | 166/154 |
| 4,658,900 | 4/1987 | Stout | 166/297 |
| 4,690,227 | 9/1987 | George et al. | 175/4.56 |
| 4,924,952 | 5/1990 | Schneider | 175/4.56 X |
| 5,161,616 | 11/1992 | Colla | 175/4.56 X |

*Primary Examiner*—William P. Neuder
*Attorney, Agent, or Firm*—G. Turner Moller

[57] ABSTRACT

An explosive or combustion actuated subsurface well tool includes a firing head for initiating operation of the tool in response to a projectile, such as a ball or go-devil, being pumped down a tubing string extending from the surface. The firing head includes a passage sized to closely receive the ball or go-devil, in either a sealed manner in which substantially no liquid leaks around the pumped projectile or in an unsealed manner in which a small amount of liquid leaks around the projectile. As the projectile moves into the passage, the pressure drop across the projectile becomes quite large creating a large force sufficient to shear a safety pin, drive home a firing pin or otherwise initiating operation of the subsurface well tool.

19 Claims, 2 Drawing Sheets

FIRING HEAD

This invention is a firing head to be attached to a subsurface well tool to initiate operation in response to a mechanical or hydraulic input.

BACKGROUND OF THE INVENTION

Subsurface well tools are of many types. One type is actuated by an explosive or combustible charge. These tools have a variety of functions, including such different devices as perforating guns, formation fracturing devices shown in U.S. Pat. Nos. 4,530,396; 4,823,876; 4,852,647; 4,976,318 and 5,005,641, well cleaning devices shown in U.S. Pat. No. 4,976,318, and the like. Typically, these devices are actuated by an electrical signal delivered to the subsurface well tool through an insulated cable. The electrical signal normally initiates combustion of a small powder charge or detonates a blasting cap. As used herein, the words combustion and combustible are intended to be broad enough to encompass explosion and explosive because the difference between the processes is essentially the rate at which the chemical combination of fuel and oxidant occurs.

There are a number of situations where it is necessary or desirable to initiate operation of subsurface combustible well tools by hydraulic or mechanical techniques because it is impractical or undesirable to run the tool on a wireline. An early example of mechanical actuation of a subsurface combustible well tool is a perforating gun. It is often desirable to run a perforating gun on the bottom of a tubing string so the well can be perforated with large, high capacity shaped charges in an underbalanced situation, i.e. where the tubing string is essentially empty so the formation pressure is much greater than the hydrostatic pressure inside the tubing string.

Ordinary wire line operations are awkward in wells with long horizontal sections because it is difficult to get the wireline tool into the horizontal section. In addition, dropped go-devils will not mechanically actuate a detonator because it will slow down or stop in the horizontal section. Thus, the only feasible technique of firing a perforating gun in a horizontal well is with a pressure actuated firing head.

It is also desirable to initiate operations of subsurface combustible well tools by hydraulic or mechanical means where liquids or liquid-gas mixtures are being pumped into a well. For example, sand consolidation operations are conducted where a propellant charge is ignited to provide a high pressure gas to drive the uncured resin from the well bore through the perforation tunnels and into the formation. A curing agent is then pumped into the zone to cure the resin. While such an operation may be conducted with a small diameter coiled tubing work string inside a production tubing string and an electric wireline cable inside the coiled tubing work string, it is often impractical because the wireline restricts flow through the coiled tubing. In addition, there is a risk of lodging the tool inside the coiled tubing if the resin becomes more viscous due to causes such as spontaneous polymerization. It is accordingly desirable to have the option of igniting the propellant charge using mechanical or hydraulic means rather than electric wireline.

The advantage of mechanically or hydraulically initiating operation of a combustible subsurface tool occurs in other multiple stage operations where it liquids or gases are injected into the formation. These operations include the injection of clay stabilizers, scale inhibitors, solvents such as xylene, acids and the like. These materials may be injected into the formation before or after ignition of the combustible device.

The standard technique for initiating operation of a combustible subsurface tool is by dropping a projectile, such as a ball, bar or go-devil through an empty tubing string. Because the projectile falls through air, it reaches a substantial velocity and has sufficient energy to break a shear pin, drive home a firing pin or otherwise set off the combustible igniter. Typical disclosures are found in U.S. Pat. Nos. 2,254,979; 2,067,408; 2,760,408 and 4,658,900.

Where the tubing string is full of liquid, dropped projectiles do not work because they do not reach substantial velocities and therefore do not generate large forces that may be necessary or desirable to initiate operation. Similar problems occur in horizontal well sections because the dropped bars or go-devils slow down or stop in the horizonal well sections.

Another disclosure of interest is found in U.S. Pat. No. 4,260,017.

SUMMARY OF THE INVENTION

In this invention, a well tool includes a firing head incorporating a combustible igniter that starts operation of the well tool. The igniter includes a powder charge and a firing pin positioned to impact the powder charge. A shear pin immobilizes the firing pin during transportation of the well tool, running the tool into the well and, with a very high safety factor, resists the increasing hydrostatic well pressures. The firing head includes a housing having a threaded connection to a liquid filled tubing string in the well, a restricted passage and one or more ports opening to the exterior of the tubing string.

A predetermined amount of liquid chemical, such as resin, is placed in the tubing string and a projectile is then inserted in the tubing string. The projectile is followed by a fluid, usually a liquid, pumped into the work string so the projectile is effectively pumped downward into the well while the liquid ahead of the projectile passes through the port and out of the tubing string. When the projectile reaches the firing head, it travels into a restricted passage where the relative sizes between the projectile and the passage substantially stops liquid movement through the ports and out of the tubing string. The projectile and/or the restricted passage may include seals to substantially block liquid movement or may be unsealed to allow some liquid leakage.

In either event, two mechanisms act on the projectile to forceably strike the firing pin and initiate combustion of the actuator. First, the momentum of the moving column of liquid above the projectile applies a substantial force to the projectile. Second, pump pressure at the surface is applied to the projectile. The projectile is of much larger cross-sectional area than the firing pin so the force created by pump pressure on the projectile is quite large. As the projectile impacts the firing pin, the shear pin fails allowing the firing pin to move. When the firing pin impacts the powder charge, combustion is started thereby commencing operation of the well tool.

A substantial advantage of this invention is safety. Although pump pressure and hydrostatic pressure continuously act on the firing pin, the firing pin cross-section is small so the force applied to the firing pin, which must be resisted by the shear pin, is small. When the projectile is in the restricted passage, pump pressure is on the top of the projectile. With a ¾" spherical projectile and a ¼" diameter firing pin, which is a typical arrangement for use on the end of coiled tubing, it will be seen that the ratio of the areas of the projectile to the firing pin is nine. Analysis will show that this ratio provides a high operational margin of safety.

It is an object of this invention to provide an improved firing head for a subsurface combustible well tool.

Another object of this invention is to provide an improved method of operating a firing head for a subsurface combustible well tool.

A further object of this invention is to provide an improved firing head that is simple and inexpensive to make, which is straight forward and reliable in operation and which has a large margin of safety.

Another object of this invention is to provide a firing head which momentarily interrupts flow in the coiled tubing string while ignition is being initiated and liquid flow is resumed when a substantial part of the projectile has cleared the passage.

An additional object of this invention is to provide a firing head which has few flow restrictions thereby allowing high flow rates in a work string to which it is attached.

Other objects and advantages of this description will become more apparent as this description proceeds, reference being made to the accompanying drawings and appended claims.

DETAILED DESCRIPTION

Figure 1:
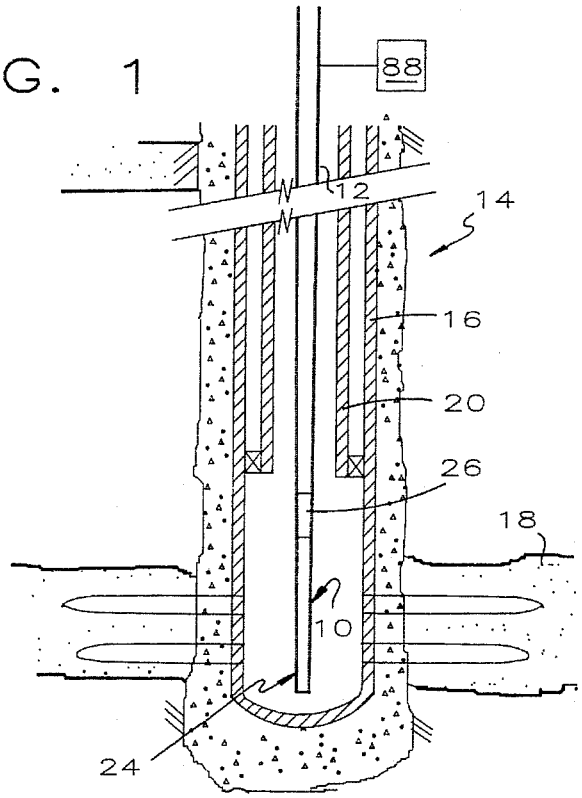
FIG. 1 is a cross-sectional view through the earth, illustrating one example of a combustible well tool immediately prior to operation.

Referring to FIGS. 1–4, a subsurface combustible well tool 10 of any suitable type is on the bottom of a coiled tubing work string 12 run into a well 14. The well 14 is a conventional petroleum well comprising a casing string 16 penetrating a hydrocarbon bearing formation 18 and cemented in place. A production tubing string 20 is positioned on a packer inside the casing string 16. The well tool 10 is illustrated as including a propellant section 24 ignited by a firing head 26 of this invention.

Figure 2:
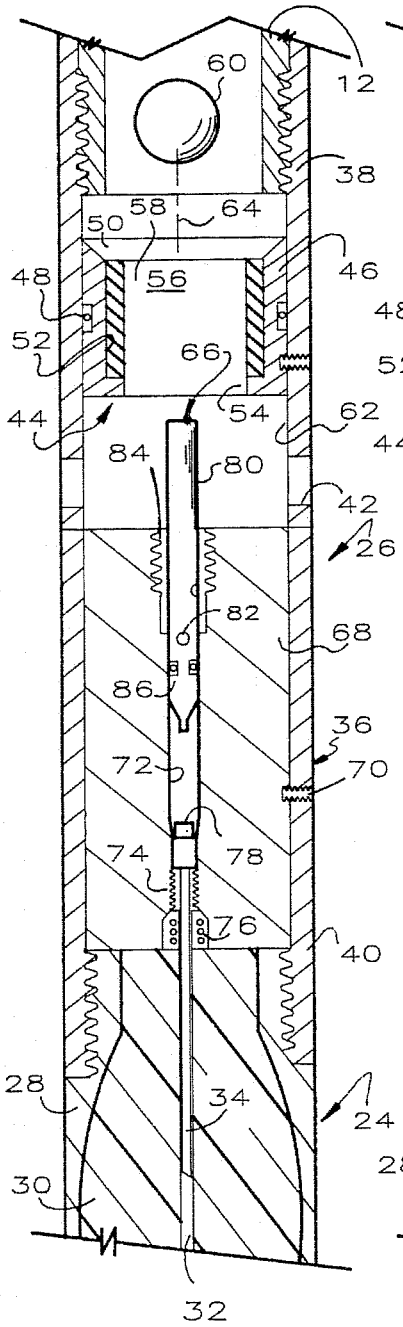
FIG. 2 is an enlarged longitudinal cross-sectional view of the tool of FIG. 1 illustrating a projectile being pumped into the firing head, just before initiation of operation.
Figure 3:
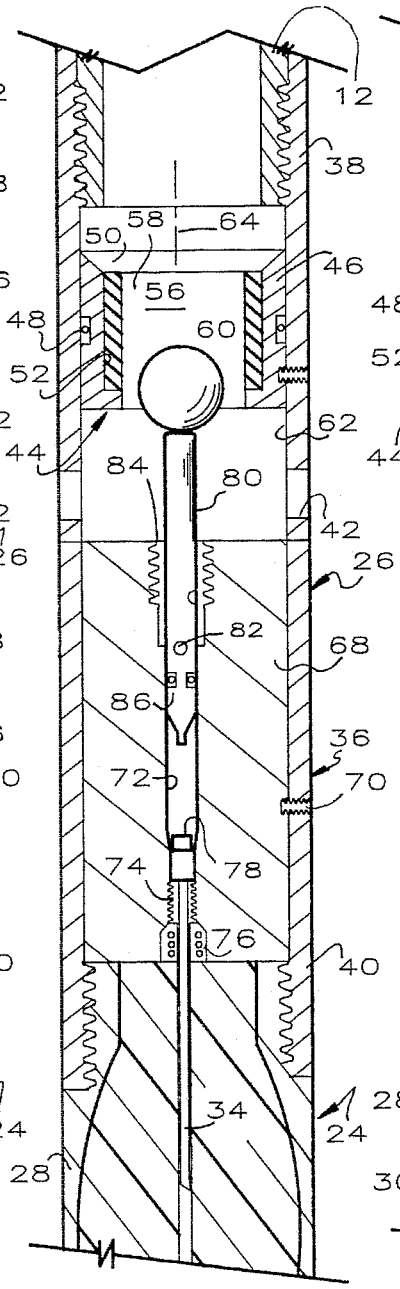
FIG. 3 is an enlarged longitudinal cross-sectional view, similar to FIG. 2, showing the projectile in its restricted passage at the moment of impact with the firing pin.
Figure 4:
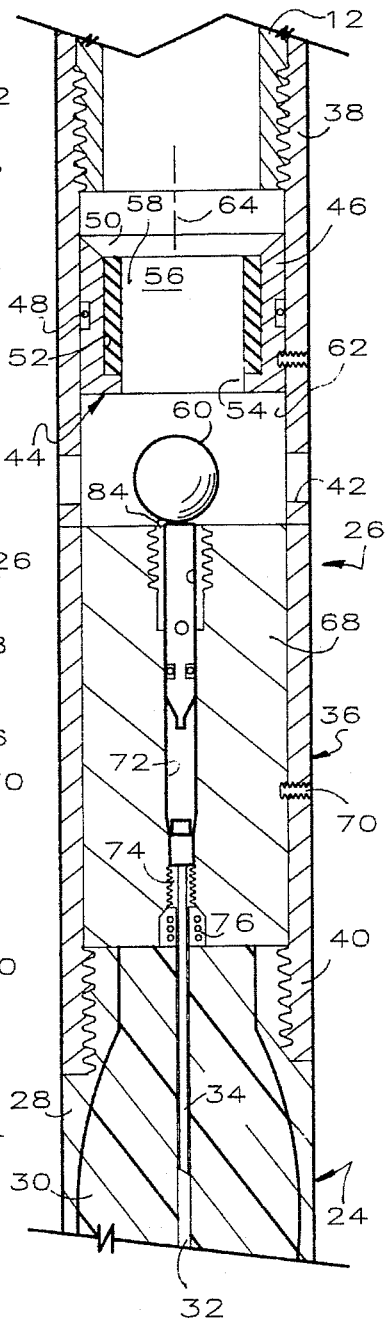
FIG. 4 is an enlarged longitudinal cross-sectional view, similar to FIGS. 2 and 3, showing the projectile after impact with the firing pin, illustrating the resumption of liquid flow through the firing head.

As shown in FIGS. 2–4, the propellant section 24 is of a conventional type including a housing 28 having an upper threaded end, a propellant charge 30 having a central passage 32 receiving a flash tube 34. Combustible tools of this type are found in U.S. Pat. Nos. 4,530,396; 4,716,967; 4,823,876; 4,852,647; 4,976,318 and 5,005,641 to which reference is made for a more complete description of the propellant section 24.

The firing head 26 includes a housing 36 having a threaded upper end 38 for connection to the work string 12 and a lower threaded end 40 for connection to the propellant housing 28. One or more ports 42 open through the housing 36. Adjacent the upper end of the housing 36 is a sleeve assembly 44 comprising an annular body 46 fixed to the housing 36 in any suitable fashion, as by the use of one or more set screws. One or more O-rings 48 may be provided to seal between the sleeve assembly 46 and the housing 36. The sleeve 44 provides a conically tapered upper end 50, a recess 52 terminating in a lower shoulder 54 and a resilient sleeve 56 bonded to the passage 52 providing a restricted central passage 58 through the housing 36.

As will become more fully apparent hereinafter, liquid is pumped down the work string 12 and out the ports 42. A ball projectile 60 is placed in the work string 12 and moves with the pumped liquid down the work string 12 and then into the passage 58 thereby at least partially sealing and preventing liquid from leaking past the ball 60. Preferably, although not essentially, the ball 60 is sized to seal against the resilient sleeve 56 to prevent liquid leakage around the ball 60.

The sleeve assembly 44 is preferably short enough to terminate above the ports 42 to leave a chamber 62 larger than the passage 58 and of a sufficient height to receive the ball 60. Thus, when the ball 60 exits through the end of the passage 58, the flow path through the ports 42 is reestablished. This feature is essential when the well tool 10 is being used in a sequential pumping operation, such as a sand control job, where liquids are pumped before and after operation of the well tool 10. It will be apparent that reestablishing liquid communication through the firing head 26 is not so essential if the operation being conducted does not pump liquids after setting off the tool 10.

Extending along the axis 64 of the firing head 26 is an ignition assembly 66 including a firing pin holder 68 secured to the housing 36 by one or more set screws 70. The holder 68 includes an axial passage 72 receiving, at a threaded passage section 74, the upper end of the flash tube 34. A series of O-ring seals 76 prevent liquid leakage into the propellant passage 32. At the upper end of the flash tube 34 is an impact primer 78 including a combustible charge, which term is intended to include an explosive charge as mentioned previously.

A firing pin 80 is secured by a shear pin 82 in the holder passage 72 at a safe position spaced from the primer 78. The upper end of the firing pin 80 extends into the chamber 62 coaxial with the passage 58. A firing pin retainer 84 is positioned in the upper end of the holder 68 and one or more O-ring seals 86 prevent liquid leakage into the passage 72. It will be seen that the upper end of the firing pin 80 is exposed to pressure in the work string 12 so the shear pin 82 must be sufficient to retain the firing pin 80 in its safe position.

The upper end of the firing pin 80 and/or the configuration of the projectile 60 are selected so the firing pin 80 is moved toward its impact position with the primer 78 at a time when the projectile 60 is in the sleeve assembly 44 and substantially preventing liquid exiting the firing head 26 through the ports 42. When a spherical projectile 60 is used, the upper end of the firing pin 80 extends substantially toward the bottom of the central passage 58 so the firing pin 80 is struck before the ball 60 exits the passage 58 and reopens communication between the work string 12 and the ports 42.

Operation of the firing head 26 will now be explained in connection with a well tool 10 used in an exemplary sand control operation. As shown in FIG. 1, the tool 10 has been run through the production string 20 of the well 14 on the bottom of a coiled tubing work string 12. With the tool 10 adjacent the formation 18, an uncured liquid resin is pumped from a suitable source 88 into the work string 12, out of the ports 42 and into the formation 18. After the desired amount of resin has been pumped into the work string 12, the projectile 60 is placed in the work string 12 and a second liquid is pumped by the source 88 into the work string 12. The second liquid usually does not react with the uncured resin and acts as a pad separating the resin from its curing agent.

After the desired quantity of second liquid has been pumped into the work string 12, a catalyst or curing agent for the resin is pumped into the work string 12. Until the ball 60 reaches the firing head 26, liquid passes into the firing head 26 from the work string 12 and exits through the ports 42. When the ball 60 enters the sleeve assembly 44, liquid leakage around the ball 60 either stops or slows down appreciably, depending on the tolerance between the ball 60 and the passage 58, the resilience of the sleeve 56 and the like.

Assuming for purposes of illustration that the ball 60 seals inside the passage 58, the ball 60 slows slightly because of the resistance of the seal. When the ball 60 contacts the firing pin 80, the momentum of the ball 60, to a small degree, and the momentum of the moving liquid column above it create a force driving the firing pin 80 downwardly. If this is insufficient to break the shear pin 82, pressure builds up inside the work string 12 as pressure from the source 88 builds up. Pump pressure acting on the ball 60 is sufficient to break the shear pin 82 and drive the firing pin 80 into the primer 78 with sufficient force to start the ignition train to ignite the flash tube 34 and ignite the propellant charge 30.

As the ball 60 exits the passage 58, the liquid path through the ports 42 is reestablished. As the propellant charge 30 burns, a quantity of relatively high pressure combustion gases discharges through the housing 28 and pushes the uncured liquid resin into the formation 18. The pressure of the combustion gases is normally sufficient to stall the pressure source 88 so, temporarily, no liquid is pumped through the ports 42 even though they are open to the work string 12. Momentarily, the pressure of the combustion gases is dissipated into the formation and liquid again moves downwardly through the work string 12, out the ports 42 and into the formation 18. The non-reactive pad is pumped into the formation followed by the resin catalyst. The resin sets up thereby causing the sand particles to stick together and control the production of sand from the well 14. It will be seen that a staged pumping operation occurs, interrupted by downhole generation of high pressure gas to push the first liquid stage into the well bore.

Figure 5:
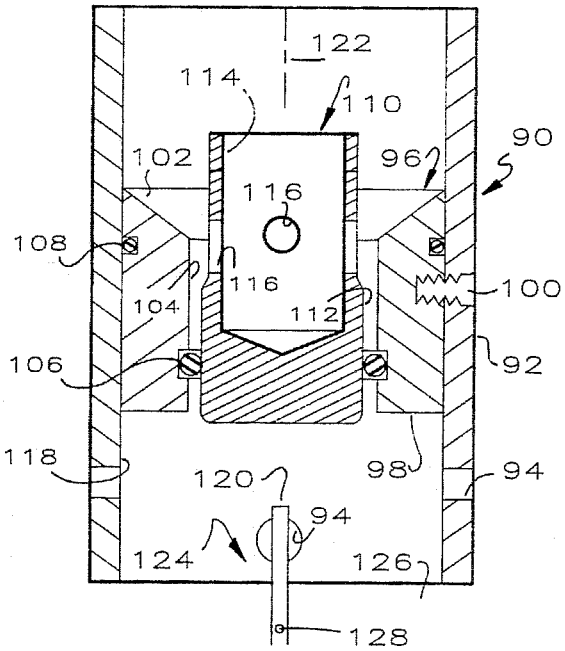
FIG. 5 is an enlarged cross-sectional view of another embodiment of this invention, showing the projectile in the restricted passage just prior to impact with the firing pin.
Figure 6:
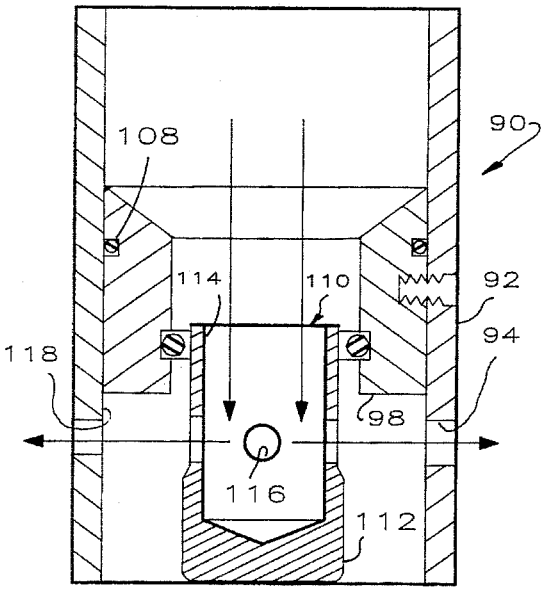
FIG. 6 is an enlarged longitudinal cross-sectional view, similar to FIG. 5, showing the projectile after impact with the firing pin, illustrating the resumption of liquid flow through the firing head.

Referring to FIGS. 5 and 6, another embodiment of the firing head 90 is illustrated comprising a housing 92 having a threaded upper end for connection to the work string 12 and a lower threaded end for connection to the propellant housing 28. One or more ports 94 open through the housing 92. Inside the housing 92 is a sleeve assembly 96 comprising an annular body 98 fixed to the housing 92 in any suitable fashion, as by the use of one or more set screws 100. The sleeve 96 provides a conically tapered upper end 102 and a restricted central passage 104 having one or more O-rings 106 therein. One or more O-rings 108 seal the outside of the sleeve assembly 96.

A cylindrical projectile or go-devil 110 is placed in the work string 12 and moves with the pumped liquid down the work string 12 and then into the passage 104 thereby at least partially sealing and preventing liquid from leaking past the go-devil. The go-devil 110 includes a lower cylindrical sealing end 112 sized to seal against the O-ring 106 and a central passage 114 opening through one or more ports 116 above the sealing section 112.

The sleeve assembly 96 is short enough to terminate above the ports 94 to leave a chamber 118 larger than the passage 104 and of a sufficient height to receive the lower end of the go-devil 110, after the firing pin 120 is depressed. Thus, when the ports 116 pass below the seals 106, the flow path through the ports 94 is reestablished.

Extending along the axis 122 of the firing head 90 is an ignition assembly 124 which is more-or-less identical to the assembly 66. The ignition assembly 124 includes a firing pin holder 126 secured to the housing 92, a shear pin 128 securing the firing pin 120 in a safe position spaced from the primer. The upper end of the firing pin 120 extends into the chamber 118 coaxial with the passage 104. It will be seen from FIG. 5 that the upper end of the firing pin 120 is exposed to well pressure and any pressure pulses in the work string 12 during initial pumping operations. Accordingly, the shear pin 128 must be sufficient to retain the firing pin 120 in its safe position.

When the go-devil 110 is pumped through the work string 12, it ultimately moves into the central passage 104 and the O-ring 106 seals against the lower cylindrical end 112. This prevents leakage around the go-devil 110 so the momentum of the liquid column above the go-devil 110 and/or pressure from the source 88 drives the go-devil 110 against the firing pin 120 to shear the pin 128. This frees the firing pin 120 so it drives against the primer and sets off the well tool 10.

As the firing pin 120 is being driven home, the lower sealing end 112 of the go-devil 110 passes through the O-ring 106. Ultimately, the ports 116 pass through the O-ring 106 and reestablish the liquid path from the work string 12 to the ports 94. This enables liquids or gases to be pumped through the firing head 90 after the well tool 10 is actuated. The go-devil 110 ultimately comes to rest against the firing pin holder 126 as shown in FIG. 6.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A firing head for initiating operation of a subsurface well tool in response to pumping liquid through a tubing string, comprising a housing having an exterior, an upper connector for securement to a tubing string, a central passage opening through the connector and at least one port opening from the passage to the housing exterior for transmitting pumped liquid from the tubing string through the housing in an unfired condition of a combustion initiator;

a combustion initiator, below the port, comprising a combustible charge, a firing pin mounted for movement to a position impacting the charge and means immobilizing the firing pin; and means pumped with liquid through the tubing string and pumped into the housing central passage for impacting the firing pin upon arrival in the central passage, breaking the immobilizing means and setting off the combustible charge comprising a projectile of a size to pass through the central passage and substantially reduce liquid exiting the housing through the port, the projectile being sized and shaped to impact the firing pin from a position at least partially inside the passage.

2. The head of claim 1 wherein the connector is of a first cross-sectional area and the central passage is of a second cross-sectional area smaller than the first cross-sectional area.

3. The head of claim 2 further comprising a sleeve, inside the housing between the connector and the port, providing the central passage.

4. The head of claim 2 wherein the port opens laterally of the sleeve.

5. The head of claim 1 further comprising resilient means in the central passage for sealably engaging the projectile.

6. The head of claim 5 wherein the resilient means comprises an elongate tubular member secured inside the central passage.

7. The head of claim 6 wherein the central passage comprises a generally cylindrical wall and the elongate tubular member comprises a resilient covering inside the cylindrical wall.

8. The head of claim 7 wherein the projectile is a ball.

9. The head of claim 5 wherein the resilient means comprises an annular seal inside the central passage.

10. The head of claim 9 wherein the projectile is cylindrical.

11. The head of claim 10 wherein the cylindrical member comprises a closed lower end, an upper end having a blind passage extending toward the lower end and at least one laterally opening port intermediate the ends of the cylindrical member, the annular seal sealing between the lower end and the port.

12. The head of claim 1 wherein the central passage provides a first section, adjacent the connector, of first cross-sectional area and a second section, adjacent the firing pin, of second cross-sectional area larger than the first cross-sectional area, the port opening into the second section, the second passage section providing a liquid path from the first passage section to the housing exterior when the projectile exits the first passage section.

13. A method of initiating operation of a subsurface combustible well tool on a tubing string, the tool including a firing head for initiating operation of a subsurface well tool in response to pumping liquid through a tubing string, comprising a housing having an exterior, an upper connector for securement to the tubing string, a central passage opening through the connector and at least one port opening from the passage to the housing exterior for transmitting pumped liquid from the tubing string through the housing in an unfired condition of a combustion initiator; a combustion initiator, below the port, comprising a combustible charge, a firing pin mounted for movement to a position impacting the charge and means immobilizing the firing pin; and means pumped with liquid through the tubing string and pumped into the housing central passage for impacting the firing pin upon arrival in the central passage, breaking the immobilizing means and setting off the combustible charge comprising a projectile of a size to pass through the central passage and substantially reduce liquid exiting the housing through the port, the projectile being sized and shaped to impact the firing pin from a position at least partially inside the passage, the method comprising filling the tubing string with a first liquid batch;

placing the projectile in the tubing string and then pumping a second liquid batch into the tubing string thereby pushing the first liquid batch and the projectile through the tubing string and delivering the first liquid batch through the port to the exterior of the housing; and passing the projectile into the passage, substantially stopping delivering liquid through the port and then impacting the firing pin, breaking the immobilizing means and driving the firing pin into the combustible charge.

14. The method of claim 13 further comprising restarting delivery of liquid through the port to the exterior of the housing.

15. The method of claim 14 wherein the restarting step comprises passing the projectile through the passage and thereby reconnecting the passage and the port.

16. The method of claim 14 wherein the projectile is cylindrical, including a blind passage opening extending from an upper projectile end through a laterally extending port above a lower projectile end, and further comprising the step of sealing between the projectile and the central passage and the restarting step comprises passing the projectile through the passage until the laterally extending port is out of sealing condition with the central passage.

17. The method of claim 13 wherein the first liquid batch is of different composition than the second liquid batch.

18. A firing head for initiating operation of a subsurface well tool in response to pumping liquid through a tubing string and through the firing head, comprising a housing having an exterior, an upper connector for securement to a tubing string, a central passage opening through the connector and at least one port opening from the passage to the housing exterior for transmitting pumped liquid from the tubing string through the housing;

a combustion initiator comprising a combustible charge, a firing pin exposed in the central passage and mounted for movement to a position impacting the charge and means immobilizing the firing pin; and means for setting off the combustible charge in response to pumping a first liquid batch through the housing and then pumping a projectile into the central passage.

19. The firing head of claim 18 wherein the projectile is of a size to pass through the central passage and substantially reduce liquid exiting the housing through the port, the projectile impacting the firing pin upon movement through the central passage, breaking the immobilizing means and setting off the combustible charge.

* * * * *